US011688927B2

(12) United States Patent
Oh et al.

(10) Patent No.: US 11,688,927 B2
(45) Date of Patent: Jun. 27, 2023

(54) DISPLAY MODULE EXCITATION FOR WIRELESS COMMUNICATIONS

(71) Applicant: GOOGLE LLC, Mountain View, CA (US)

(72) Inventors: Sung Oh, San Jose, CA (US); Uei-ming Jow, San Diego, CA (US); Huan Liao, San Jose, CA (US)

(73) Assignee: Google LLC, Mountain View, CA (US)

( * ) Notice: Subject to any disclaimer, the term of this patent is extended or adjusted under 35 U.S.C. 154(b) by 327 days.

(21) Appl. No.: 16/947,222

(22) Filed: Jul. 23, 2020

(65) Prior Publication Data

US 2021/0066781 A1 Mar. 4, 2021

Related U.S. Application Data

(60) Provisional application No. 62/892,068, filed on Aug. 27, 2019.

(51) Int. Cl.
*H01Q 1/22* (2006.01)
*H01Q 1/48* (2006.01)

(52) U.S. Cl.
CPC ..... *H01Q 1/2266* (2013.01); *H01Q 1/48* (2013.01)

(58) Field of Classification Search
CPC ..... H01Q 1/2266; H01Q 1/243; H01Q 1/273; H01Q 1/38–48
See application file for complete search history.

(56) References Cited

U.S. PATENT DOCUMENTS

| | | | | |
|---|---|---|---|---|
| 10,355,344 | B1 | 7/2019 | Ruaro et al. | |
| 2010/0321325 | A1 | 12/2010 | Springer et al. | |
| 2015/0255856 | A1 | 9/2015 | Hong et al. | |
| 2017/0033439 | A1* | 2/2017 | Liu | H01Q 1/243 |
| 2019/0074586 | A1 | 3/2019 | Ruaro et al. | |
| 2019/0372205 | A1* | 12/2019 | Ruaro | H01Q 13/10 |
| 2020/0021008 | A1* | 1/2020 | Yong | H01Q 21/005 |
| 2020/0136234 | A1* | 4/2020 | Paulotto | H01Q 15/0026 |

FOREIGN PATENT DOCUMENTS

CN 204809404 U 11/2015

OTHER PUBLICATIONS

International Search Report and Written Opinion for PCT Application No. PCT/US2020/070309, dated Oct. 15, 2020, 11 pages.

* cited by examiner

*Primary Examiner* — Hasan Islam
(74) *Attorney, Agent, or Firm* — Kilpatrick Townsend & Stockton LLP

(57) ABSTRACT

According to an aspect, a display device includes a display module including a display panel and a conductive layer, and an enclosure configured to surround the display module, where the enclosure includes a conductive portion. The display device includes an antenna having a structure formed by an air gap disposed between the conductive layer and the conductive portion of the enclosure. The antenna includes an antenna feed located within the air gap. The antenna feed is coupled to the conductive portion of the enclosure and to the conductive layer such that at least a portion of the display module is configured as a radiating element for wireless communication.

16 Claims, 8 Drawing Sheets

DISPLAY MODULE EXCITATION FOR WIRELESS COMMUNICATIONS

CROSS REFERENCE TO RELATED APPLICATION

This application is a non-provisional of, and claims priority to, U.S. Provisional Application No. 62/892,068, filed on Aug. 27, 2019, entitled "Display Module Excitation for Wireless Communications", which is incorporated by reference herein in its entirety.

BACKGROUND

Modern electronics are trending towards larger display screens with narrower bezels. However, in some cases, the bezel area cannot be reduced because the bezel area is used for conventional antennas. In some cases, conventional antennas such slot antennas use a relatively narrow bezel area, but the enclosure is thicker, thereby increasing the size of the electronic device, which may not be desirable for modern electronics.

SUMMARY

According to an aspect, a display device includes a display module including a display panel and a conductive layer, and an enclosure configured to surround the display module, where the enclosure includes a conductive portion. The display device includes an antenna having a structure formed by an air gap located between the conductive layer and the conductive portion of the enclosure. The antenna includes an antenna feed located within the air gap. The antenna feed is coupled to the conductive portion of the enclosure and to the conductive layer such that at least a portion of the display module is configured as a radiating element for wireless communication.

According to some aspects, the display device includes one or more of the following features (or any combination thereof). The display device includes a ground wall configured to electrically connect a portion of the display module to the enclosure. The portion of the display module configured as the radiating element includes a corner portion of the display module. The portion of the display module configured as the radiating element includes a side portion extending from a first edge of the display module to a second edge of the display module. The entire display module may be configured as the radiating element. The antenna includes a ground component located within the air gap, where the ground component is coupled to the conductive layer and to the enclosure. The air gap has a thickness in a range of 1-2 millimeters. The antenna is one of a plurality of antennas included within the display device, where each of the plurality of antennas is configured to cause a respective corner portion of the display module to operate as a separate radiating element for wireless communication.

According to an aspect, a display device includes a display module including a display panel and a conductive layer coupled to a first surface of the display panel, a transparent substrate coupled to a second surface of the display panel, and an enclosure configured to surround the display module, where the enclosure includes an interior surface and a sidewall. The interior surface includes a conductive portion, and the display module has one or more portions electrically grounded to the conductive portion. The display device includes a bezel area located between an edge of the display module and the sidewall, and an antenna having a structure formed by an air gap disposed between the conductive layer and the conductive portion. The antenna includes an antenna feed disposed within the air gap. The antenna feed is coupled to the conductive layer and the conductive portion such that at least a portion of the display module is configured as a radiating element for wireless communication.

According to some aspects, the display device includes one or more of the following features (or any combination thereof). The width of the bezel area may be less than one millimeter. The display device may include a ground wall disposed between the conductive layer and the enclosure, where the ground wall is disposed adjacent to the air gap. The ground wall may include a conductive gasket. The ground wall includes a first ground wall portion and a second ground wall portion, where the first ground wall portion extends from a location aligned with a first edge of the display module, and the second ground wall portion extends from a location aligned with a second edge of the display module. The portion of the display module configured as the radiating element is a corner portion of the display module. The antenna is one of a plurality of antennas included within the display device, where each of the plurality of antennas is configured to cause a respective corner portion of the display module to operate as a separate radiating element for wireless communication According to an aspect, a display device includes a display module including a display panel and a conductive layer coupled to a first surface of the display panel, a transparent substrate coupled to a second surface of the display panel, and an enclosure configured to surround the display module, where the display module has one or more portions electrically grounded to the enclosure. The display device includes a bezel area disposed between an edge of the display module and a sidewall of the enclosure, and a plurality of antennas, where each antenna uses a separate portion of the display module as a radiating element for wireless communication. Each antenna has a structure formed by a separate air gap disposed between the conductive layer of the display module and the enclosure, where each antenna includes an antenna feed disposed within a respective air gap, and the antenna feed is coupled to the conductive layer and to the enclosure.

According to some aspects, the display device includes one or more of the following features (or any combination thereof). The width of the bezel area may be less than one millimeter. The plurality of antennas include a first antenna and a second antenna, where the first antenna defines a first corner portion of the display module as a first radiating element, and the second antenna defines a second corner portion of the display module as a second radiating element. The display device includes a plurality of ground walls disposed between the conductive layer and the enclosure. Each antenna includes a ground component disposed within a respective air gap, where the ground component is coupled to the conductive layer and to the enclosure.

DETAILED DESCRIPTION

This disclosure provides a display device having a unique antenna structure that uses one or more portions of a display module as radiating element(s) for wireless communication, which may cause the bezel area to be reduced (or eliminated) (thereby providing additional space for a display screen). In some examples, the bezel area may be reduced to less than one millimeter. The antenna is not formed in the bezel area but is created by an air gap between an enclosure and a portion of the display module, where the portion of the display module is configured to operate as a radiating element for wireless communication. In some examples, the antenna is a Wi-Fi configured to operate at one or more frequency bands. In some examples, the air gap is relatively small (e.g., approximately one to two millimeters). In some examples, the portion of the display module used for the antenna is a corner portion of the display module. In some examples, the portion of the display module used for the antenna is a side portion of the display module. In some examples, the display module (as a whole) is configured as the radiating element.

In some examples, the antenna is not arranged within the display module but arranged outside the display module using the space (air gap) between a bottom metal layer of the display module and the enclosure (e.g., a metal enclosure) to create the antenna structure. In some examples, the computing device includes multiple antennas, where each antenna is formed using a separate corner portion of the display module (e.g., four separate antennas, one at each corner portion of the display module). The manufacturing costs may be reduced because the antenna is created using the already existing display module and the enclosure, and, in some examples, may not require typical antenna parts such as slots (e.g., slots in the enclosure or frame), metal (antenna) traces, antenna wires, printed monopoles, patch antenna components, metal materials defining patterns or slots, mesh metal layer(s), ceramic antenna components, laser direct structure antenna components, and/or flex traces. In some examples, structure of the antenna(s) described herein may permit the enclosure to be entirely metal, thereby increasing the durability of the display device while providing relatively good antenna performance.

Figure 1A:
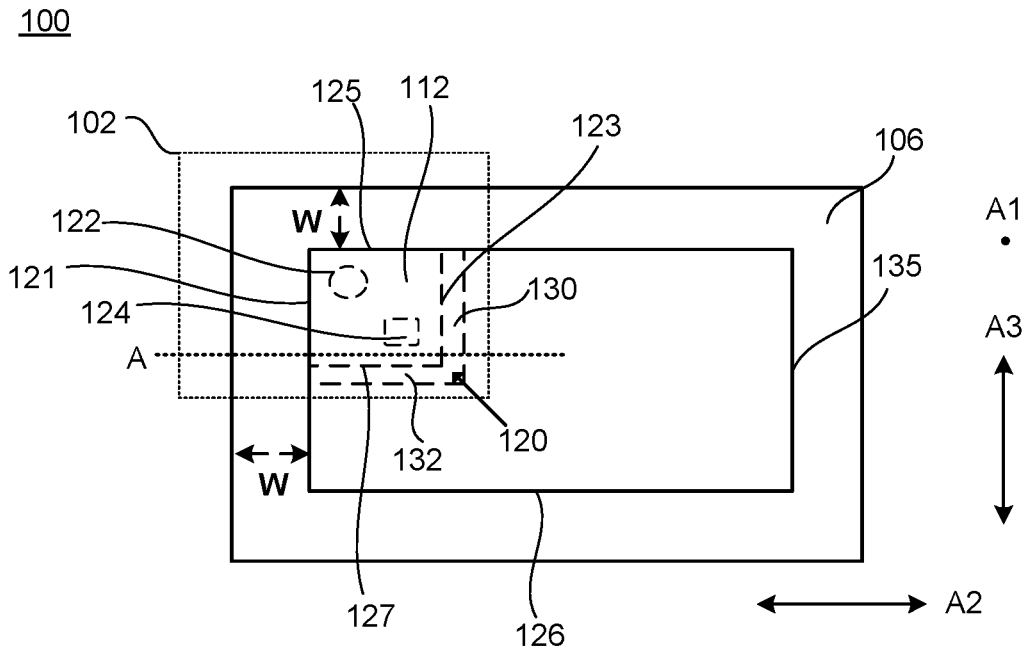
FIG. 1A illustrates a top view of a display device that uses a display module and an enclosure for creating an antenna according to an aspect.
Figure 1B:
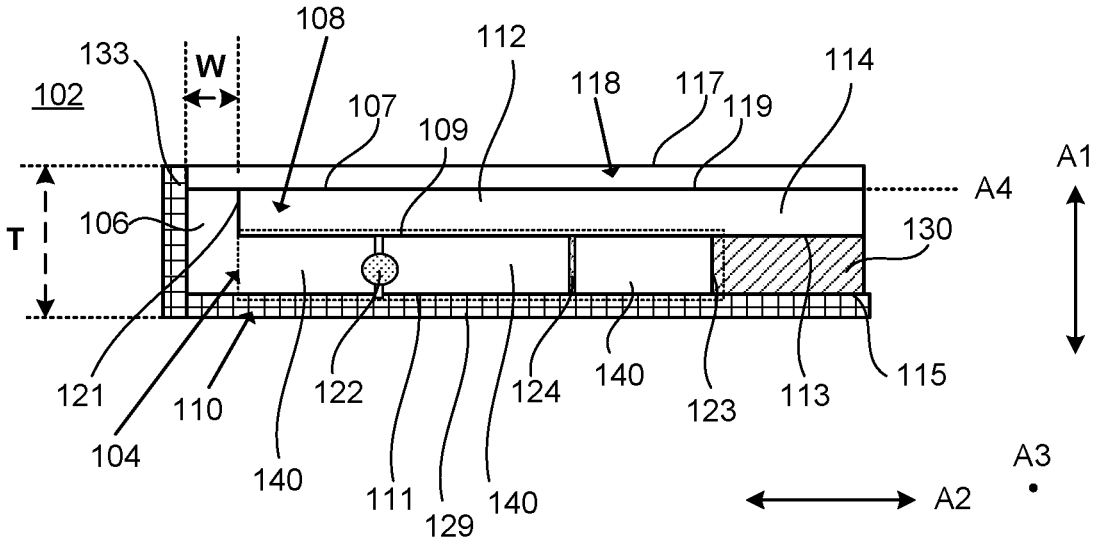
FIG. 1B illustrates a cross-sectional view of the display device according to an aspect.

FIG. 1A illustrates a top view of a display device 100 and FIG. 1B illustrates a cross-sectional view of a portion 102 of the display device 100 taken along a line A according to an aspect. Referring to FIGS. 1A and 1B, the display device 100 defines an antenna 104 using a display module 108 and an enclosure 110 such that a portion 112 of the display module 108 is configured as a radiating element for wireless communication. For example, the portion 112 of the display module 108 forms part of the antenna 104 for wireless communication.

In some examples, as shown in FIG. 1A, the portion 112 is a corner portion of the display module 108. In some examples, the portion 112 may be another portion of the display module 108 such as a side portion. In some examples, the antenna 104 is not defined in a bezel area 106, which may cause the width W of the bezel area 106 to be reduced (or eliminated) and/or the thickness T of the display device 100 to be reduced. Furthermore, since the antenna 104 may be substantially defined using existing components of the display device 100 (e.g., the display module 108, the enclosure 110), the display device 100 may not include other typical antenna parts slots (e.g., slots in the enclosure or frame), metal (antenna) traces, antenna wires, printed monopoles, patch antenna components, metal materials defining patterns or slots, mesh metal layer(s), ceramic antenna components, laser direct structure antenna components, and/or flex traces.

The antenna 104 may send and/or receive wireless signals (e.g., radio frequency signals) such that the display device 100 may wirelessly communicate with another device. In some examples, the antenna 104 is a Wi-Fi antenna. In some examples, the antenna 104 is a Wi-Fi antenna configured to operate at one or more frequency bands (e.g., at 2.4 GHz, 5.5 GHz). In some examples, the antenna 104 is a short-range antenna (e.g., near-field communication (NFC) antenna, Bluetooth antenna). However, it is noted that the antenna 104 may be turned to operate at any number of frequency bands.

The display device 100 may be any type of display device configured to wirelessly communicate with another computing device using one or more antennas. The display device 100 may be a laptop, a smartphone, tablet, wearable devices (e.g., smart watches, etc.), personal digital assistant (PDA), personal computer, or a display monitor, etc.

The display module 108 may define the display screen (e.g., the active viewing area) of the display device 100. In some examples, the display module 108 includes an array of diodes as pixels for a video display. The display module 108 may include a display panel (e.g., including the array of diodes and other substrate layers) and a conductive layer coupled to the display panel. The conductive layer may include one or more metal-based materials such as magnesium, alloy, titanium, copper, aluminum, gold, silver, etc. The conductive layer may be coupled to the surface (e.g., the bottom surface) of the display panel. The display panel may be a liquid crystal display (LCD) panel, a light emitting diode (LED) panel, an organic light emitting diode (OLED) panel, or an active matrix organic light emitting diode (AMOLED) panel. In some examples, the display panel includes one or more substrates such as a thin-film transistor (TFT) array, one or more polarizing plates, a backlight unit (BLU), a touch panel, one or more transparent layers, and/or one or more conductive films, etc.

The display module 108 includes a first surface 107 and a second surface 109 disposed opposite to the first surface 107. In some examples, the first surface 107 is a touch panel. In some examples, the first surface 107 is an indium tin oxide (ITO) layer of the touch panel. In some examples, the second surface 109 of the display module 108 is a metal layer. The first surface 107 may be disposed in a plane A4. The second surface 109 is parallel to the first surface 107. A direction A1 is aligned perpendicular to the plane A4, and a direction A2 is perpendicular to the direction A1. A direction A3 is aligned parallel to the plane A4 and is orthogonal to directions A1 and A2. A dot indicates a direction into (and out of) the page. Since FIG. 1A is a top view of the display device 100, the direction A1 is indicated as a dot extending into and out of the page, but, in FIG. 1B, the direction A1 is indicated as an arrow since FIG. 1B is a cross-sectional view of the portion 102 of the display device 100. The directions A1, A2, and A3, and plane A4, are used throughout several of the various views of the implementations described throughout the figures for simplicity.

The distance between the first surface 107 and the second surface 109 in the direction A1 may define the thickness of the display module 108. The display module 108 may define an edge 121 and an edge 135. The distance between the edge 121 and the edge 135 in the direction A2 may define a width of the display module 108. The display module 108 may define an edge 125 and an edge 126. The distance between the edge 125 and the edge 126 in the direction A3 may define a length of the display module 108.

The display device 100 includes a transparent substrate 118 coupled to the display module 108. The transparent substrate 118 may be constructed from one or more transparent materials such that visual data can pass through the transparent substrate 118. In some examples, the transparent substrate 118 includes an organic material. In some examples, the transparent substrate 118 includes an inorganic material. In some examples, the transparent substrate 118 includes a glass cover. In some examples, the transparent substrate 118 is coupled to a sidewall 133 of the enclosure 110. The transparent substrate 118 includes a first surface 117 and a second surface 119 disposed opposite to the first surface 117. The distance between the first surface 117 and the second surface 119 may define a thickness of the transparent substrate 118. In some examples, the first surface 117 of the transparent substrate 118 defines a top exterior surface of the display device 100. The second surface 119 of the transparent substrate 118 is coupled to the first surface 107 of the display module 108.

The enclosure 110 (also referred to as a case or a housing) may be constructed from one or more conductive materials such as magnesium, alloy, titanium, copper, aluminum, gold, silver, etc. In some examples, the enclosure 110 is entirely metal. In some examples, the enclosure 110 is a full metal cover surrounding the display module 108. In some examples, the enclosure 110 includes one or more metal portions and one or more non-metal portions. The enclosure 110 includes an interior surface 111 and an outer surface 129 disposed opposite to the interior surface 111. In some examples, a metal portion is disposed on the interior surface 111 (or on a portion thereof). The outer surface 129 of the enclosure 110 may define the bottom exterior surface of the display device 100. In some examples, the enclosure 110 includes a sidewall 133. The sidewall 133 (or portions thereof) may extend in the direction A1. In some examples, the sidewall 133 (or portions thereof) is orthogonal to the interior surface 111 and to the outer surface 129.

Referring to FIG. 1A, in some examples, the display device 100 includes a ground wall 120 disposed between the display module 108 and the enclosure 110. In some examples, the shape and location of the ground wall 120 between the display module 108 and the enclosure 110 may define the shape and the location of the portion 112 of the display module 108 that is used to form part of the antenna 104. The ground wall 120 electrically connects (grounds) portions (e.g., bottom portions) of the display module 108 to the enclosure 110. The ground wall 120 may be one or more conductive structures having one or more conductive materials configured to electrically and physically connect portions of the display module 108 to the enclosure 110. In some examples, the ground wall 120 may create an air gap 140 between portions of the display module 108 and the enclosure 110. The air gap 140 may be adjacent (e.g., directly adjacent) to the ground wall 120 in the direction A2. In some examples, the ground wall 120 includes a conductive gasket. In some examples, the ground wall 120 includes a conductive foam. In some examples, the ground wall 120 includes one or more metal springs, conductive foam, and/or conductive fiber, etc.

The ground wall 120 includes a ground wall portion 130 extending along a direction A3, and a ground wall portion 132 extending along a direction A2, where the ground wall portion 130 and the ground wall portion 132 have a thickness extending in a direction A1. In some examples, the ground wall portion 130 and the ground wall portion 132 form an L shape. In some examples, the ground wall portion 130 is linear. In some examples, the ground wall portion 132 is linear. In some examples, the ground wall portion 130 and/or the ground wall portion 132 include one or more non-linear portions. In some examples, the ground wall portion 130 and the ground wall portion 132 are separate portions of a unitary (single) body. In some examples, the ground wall portion 130 and the ground wall portion 132 are separate unitary bodies that contact each other. In some examples, the ground wall portion 130 extends from a location aligned with the edge 125 of the display module 108 in the direction A3, and the ground wall portion 132 extends from a location aligned with the edge 121 in the direction A2.

Referring to FIG. 1B, the display module 108 includes a portion 114 electrically grounded to the enclosure 110. In some examples, the ground wall portion 130 is disposed between the portion 114 of the display module 108 and the enclosure 110 to electrically connect (ground) the portion 114 of the display module 108 to the enclosure 110. For example, the ground wall portion 130 includes a first end 113 coupled to the second surface 109 (e.g., the surface of a metal layer) of the display module 108, and a second end 115 coupled to the enclosure 110 (e.g., a metal enclosure or a metal portion of the enclosure 110).

The antenna 104 is formed at least by the air gap 140 between the portion 112 of the display module 108 and the enclosure 110. For example, the air gap 140 between the enclosure 110 (e.g., a metal enclosure or an enclosure having a metal portion) and the display module 108 (e.g., the metal bottom portion of the display module 108) creates the structure of the antenna 104 when portions of the display module 108 is electrically connected (grounded) to the enclosure 110 (e.g., via the ground wall 120). In some examples, the antenna 104 has a first edge defined by the edge 121 of the display module 108 and a second edge defined by the edge 125 of the display module 108. In some examples, the antenna 104 is an antenna with two edges, e.g., the edge 121 and the edge 125.

In some examples, the air gap 140 is a three-dimensional space disposed between the portion 112 of the display module 108 and the enclosure 110. The air gap 140 has a height extending in the direction A1 and between the second surface 109 of the display module 108 and the interior surface 111 of the enclosure 110. In some examples, the interior surface 111 is metal or includes one or more conductive portions. In some examples, the height of the air gap 140 is less than three millimeters. In some examples, the height of the air gap 140 is in a range of one to two millimeters. In some applications, the thickness T of the display device 100 is critical, where the antenna's structure may provide a relatively small height for the air gap 140, which may cause the thickness T of the display device 100 to be reduced. The air gap 140 may have a length extending in the direction A2 and between a location aligned with the edge 121 of the display module 108 and an edge 123 of the ground wall portion 130. Also, the air gap 140 may have a width extending in the direction A3 and between a location aligned with the edge 125 of the display module 108 and an edge 127 of the ground wall portion 132.

In some examples, the portion 112 of the display module 108 configured as the radiating element is a corner portion of the display module 108. In some examples, the portion 112 has a rectangular shape. In some examples, the portion 112 has a non-rectangular shape such as an irregular shape, e.g., multiple different widths and/or lengths. The portion 112 of the display module 108 may have a width that extends from the edge 121 of the display module to the ground wall portion 130 in the direction A2 and a length that extends from the edge 125 to the ground wall portion 132 in the direction A3. In some examples, the width of the portion 112 is greater than the length of the portion 112. In some examples, the area of the portion 112 is less than 25% of the total area of the display module 108. In some examples, the width of the portion 112 of the display module 108 is in a range of 30 to 70 millimeters. In some examples, the width of the portion 112 of the display module 108 is in a range of 40 to 60 millimeters. In some examples, the length of the portion 112 is in a range of 30 millimeters to 50 millimeters. In some examples, the length of the portion 112 is in a range of 35 millimeters to 45 millimeters.

The antenna 104 includes an antenna feed 122 coupled to the display module 108 and the enclosure 110. The antenna feed 122 is disposed within the air gap 140. The antenna feed 122 is coupled to the second surface 109 of the portion 112 of the display module 108. The antenna feed 122 is coupled to the interior surface 111 of the enclosure 110. In some examples, the antenna feed 122 is a transmission line (e.g., cable) that connects the antenna 104 with a transmitter and/or receiver (not shown).

The antenna 104 includes a ground component 124 coupled to the display module 108 and the enclosure 110. The ground component 124 may be used to tune the antenna 104. For example, the location of the ground component 124 within the air gap 140 including its proximity to the antenna feed 122 may define one or more of the antenna's frequency bands. In some examples, the ground component 124 is a conductive structure (e.g., metal-based structure) that connects a portion of the display module 108 to the enclosure 110. In some examples, the ground component 124 is a ground leg. In some examples, the ground component 124 is a ground pin. In some examples, the ground component 124 includes a spring clip, a pogo pin, a conductive foam, or a conductive gasket. The ground component 124 is coupled to the second surface 109 of the portion 112 of the display module 108. The ground component 124 is coupled to the interior surface 111 of the enclosure 110. In some examples, the antenna feed 122 is positioned at a location that is closer to a location aligned with the edge 121 of the display module 108 (and/or a location aligned with the edge 125 of the display module 108) than the ground component 124. In some examples, the air gap 140 only includes the antenna feed 122 and the ground component 124 (e.g., the air gap 140 is devoid of physical components except for the antenna feed 122 and the ground component 124). In some examples, the air gap 140 is devoid of conductive parts except for the antenna feed 122 and the ground component 124. In some examples, the air gap 140 includes the antenna feed 122, the ground component 124, and a non-conductive component (e.g., a plastic component) that is inserted into the air gap 140 to support the antenna structure.

As shown in FIGS. 1A and 1B, the antenna 104 is formed using the existing components of the display device 100 (e.g., the display module 108, the enclosure 110) to create the air gap 140 between the display module 108 and the enclosure 110. Furthermore, since the antenna 104 may be defined using existing components of the display device 100, the display device 100 may not include other typical antenna parts such as slots (e.g., slots in the enclosure or frame), metal (antenna) traces, antenna wires, printed monopoles, patch antenna components, metal materials defining patterns or slots, mesh metal layer(s), ceramic antenna components, laser direct structure antenna components, and/or flex traces.

The antenna 104 is not formed within or embedded into the display module 108, but rather uses the metal bottom (or portion thereof) of the display module 108 in conjunction with the enclosure 110 to provide the air gap 140, thereby creating the antenna 104 when, in some examples, portions of the display module 108 are grounded to the enclosure 110. The antenna 104 is not defined in the bezel area 106, which may cause the width W of the bezel area 106 to be reduced (or eliminated) and/or the thickness T of the display device 100 to be reduced. In some examples, the width W of the bezel area 106 is less than five millimeters. In some examples, the width W of the bezel area 106 is less than three millimeters. In some examples, the width W of the bezel area 106 is less than one millimeter. In some examples, the width W of the bezel area 106 is substantially zero (e.g., bezel-less) (e.g., less than one millimeter or less than 0.5 millimeter).

Figure 2:
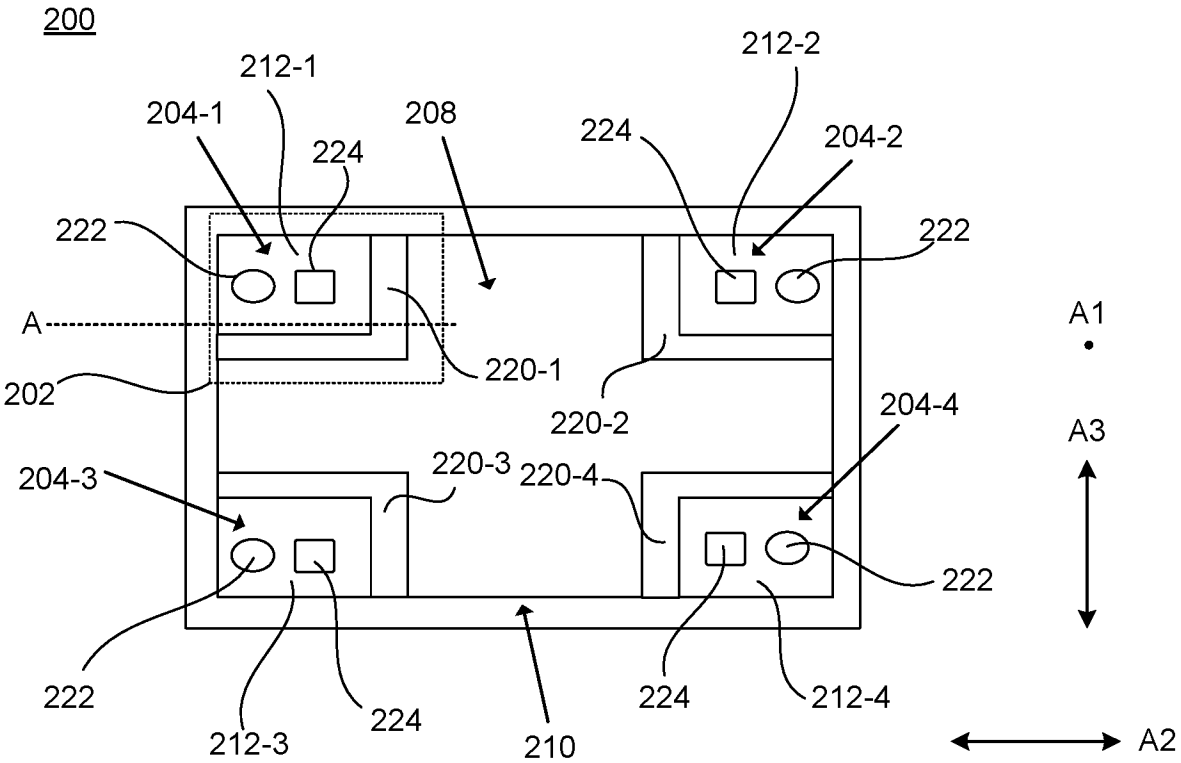
FIG. 2 illustrates a display device including multiple antennas that use corner portions of a display module as radiating elements according to an aspect.

FIG. 2 illustrates a top view of a display device 200 including multiple (separate) antennas according to an aspect. For example, the display device 200 uses corner portions of a display module 208 as radiating elements. The display device 200 may include any of the features discussed with reference to the display device 100 of FIGS. 1A and 1B. For example, the display device 200 includes air gaps (e.g., the air gap 140 of FIG. 1B) between the display module 208 and an enclosure 210 in the direction A1, and ground walls (e.g., the ground wall 120 of FIG. 1A) to separate the air gaps (and ground portions of the display module 208 to the enclosure 210), thereby creating separate antennas using the four corners of the display module 208.

For example, the display device 200 includes a first antenna 204-1 defined by a first corner portion 212-1 of the display module 208, a second antenna 204-2 defined by a second corner portion 212-2 of the display module 208, a third antenna 204-3 defined by a third corner portion 212-3 of the display module 208, and a fourth antenna 204-4 defined by a fourth corner portion 212-4 of the display module 208. Each of the antennas (e.g., 204-1, 204-2, 204-3, 204-4) may be a separate instance of the antenna 104 of FIGS. 1A and 1B and may include any of the features discussed with reference to FIGS. 1A and 1B. For example, FIG. 1B may be a cross-sectional view of a portion 202 of the display device 200 taken across line A. Each of the antennas (e.g., 204-1, 204-2, 204-3, 204-4) includes an antenna feed 222 and a ground component 224 as previously discussed with reference to FIGS. 1A and 1B.

In some examples, the display device 200 includes two antennas (e.g., any two of the first antenna 204-1, the second antenna 204-2, the third antenna 204-3, and the fourth antenna 204-4). In some examples, the display device 200 includes three antennas (e.g., any three of the first antenna 204-1, the second antenna 204-2, the third antenna 204-3, and the fourth antenna 204-4). In some examples, the antennas (e.g., 204-1, 204-2, 204-3, and/or 204-4) are Wi-Fi antennas. In some examples, the antennas (e.g., 204-1, 204-2, 204-3, and/or 204-4) are Wi-Fi antennas and short-range antennas. In some examples, two or more of the antennas (e.g., 204-1, 204-2, 204-3, and/or 204-4) are configured to operate at a different frequency band. In some examples, each of the antennas (e.g., 204-1, 204-2, 204-3, and/or 204-4) are configured to operate at a different frequency band.

The display device 200 includes a first ground wall 220-1 disposed between the display module 208 and the enclosure 210, where the air gap between the first corner portion 212-1 of the display module 208 and the enclosure 210 creates the antenna space for the first antenna 204-1. The display device 200 includes a second ground wall 220-2 disposed between the display module 208 and the enclosure 210, where the air gap between the second corner portion 212-2 of the display module 208 and the enclosure 210 creates the antenna space for the second antenna 204-2. The display device 200 includes a third ground wall 220-3 disposed between the display module 208 and the enclosure 210, where the air gap between the third corner portion 212-3 of the display module 208 and the enclosure 210 creates the antenna space for the third antenna 204-3. The display device 200 includes a fourth ground wall 220-4 disposed between the display module 208 and the enclosure 210, where the air gap between the fourth corner portion 212-4 of the display module 208 and the enclosure 210 creates the antenna space for the fourth antenna 204-4.

Figure 3:
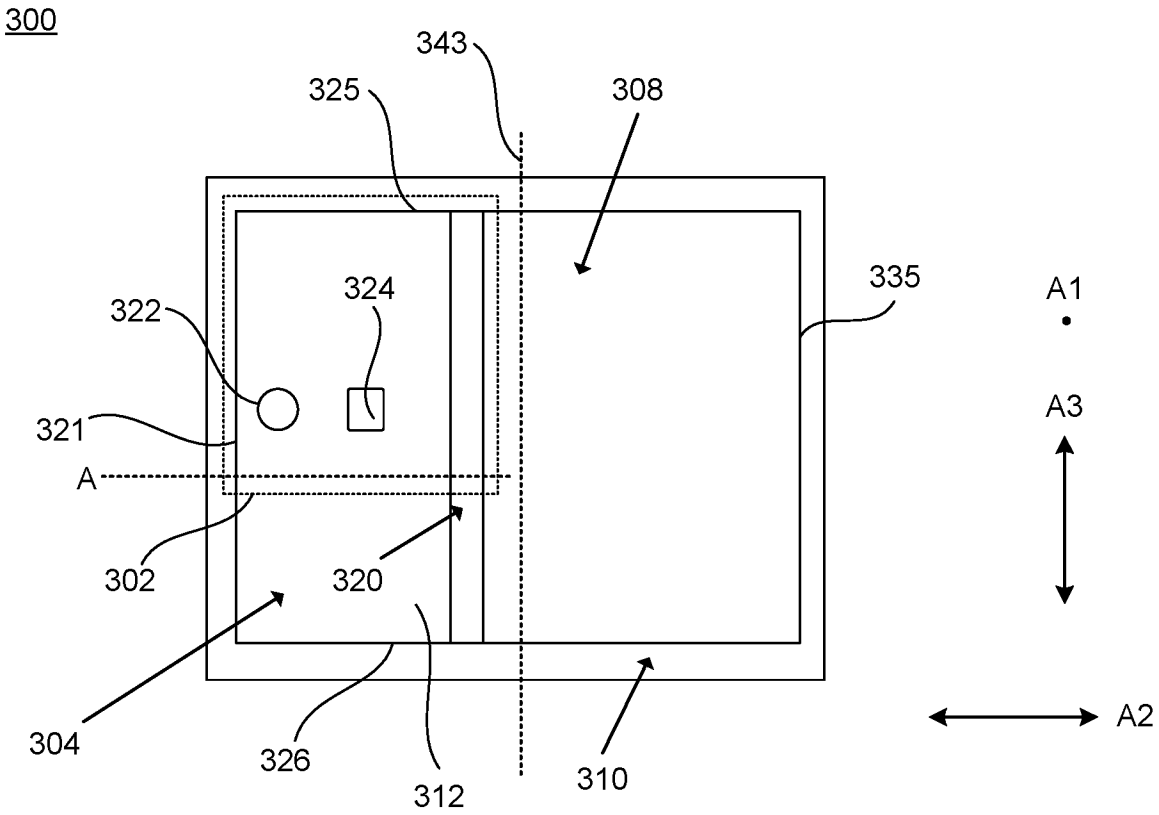
FIG. 3 illustrates a display device having an antenna according to another aspect.

FIG. 3 illustrates a top view of a display device 300 having an antenna 304 according to another aspect. For example, the display device 300 uses a side portion 312 of a display module 308 as a radiating element of the antenna 304. In some examples, the antenna 304 includes three edges (e.g., edge 321, edge 325, edge 326) of the display module 308. The display device 300 may include any of the features discussed with reference to the display device 100 of FIGS. 1A and 1B and/or the display device 200 of FIG. 2. In some examples, FIG. 1B is a cross-sectional view of a portion 302 of the display device 300 taken across line A and includes any of the details discussed herein. The antenna 304 includes an antenna feed 322 and a ground component 324 as previously discussed with reference to FIGS. 1A and 1B.

The display device 300 includes an air gap (e.g., the air gap 140 of FIG. 1B) between the display module 308 and an enclosure 310, and a ground wall 320 to electrically connect (e.g., ground) a portion of the display module 308 to the enclosure 310, thereby creating the antenna 304 using the side portion 312 of the display module 308 as a radiating element.

As shown in FIG. 3, the display module 308 may define an edge 321 and an edge 335. The distance between the edge 321 and the edge 335 in the direction A2 may define a width of the display module 308. The display module 308 may define an edge 325 and an edge 326. The distance between the edge 325 and the edge 326 in the direction A3 may define a length of the display module 308. The ground wall 320 may extend in the direction A3 between a location aligned with the edge 325 and a location aligned with the edge 326. In some examples, the ground wall 320 is linear between the location aligned with the edge 325 and the location aligned with the edge 326. In some examples, the ground wall 320 includes one or more non-linear (e.g., curved or bent) portions between the location aligned with the edge 325 and the location aligned with the edge 326. In some examples, the ground wall 320 has a length substantially equal to the length of the display module 308. In some examples, the ground wall 320 has a length less than the length of the display module 308. The ground wall 320 is disposed at a location in the direction A2 between a location aligned with the edge 321 and a location aligned with the edge 335 (e.g., either side of a central axis 343 that divides the display module 308 into equal parts). In some examples, the ground wall 320 extends along the central axis 343.

In some examples, the antenna 304 is an antenna with three edges, e.g., the edge 325, the edge 321, and the edge 326. The area of the side portion 312 of the display module 308 (e.g., used as the antenna 304) may be defined by the distance between the edge 321 of the display module 308 and the ground wall 320 in the direction A2 and the distance between the edge 325 of the display module 308 and the edge 335 of the display module 308 in the direction A3. In some examples, the side portion 312 may be less than 50% of the total area of the display module 308 (e.g., the ground wall 320 extending on a first side of the central axis 343 as shown in FIG. 3). In some examples, the ground wall 320 is located (along the direction A2) closer to a location aligned with the edge 335 (e.g., the ground wall 320 extending on a second side of the central axis 343), where the area of the side portion 312 is greater than 50% of the total area of the display module 308.

Figure 4:
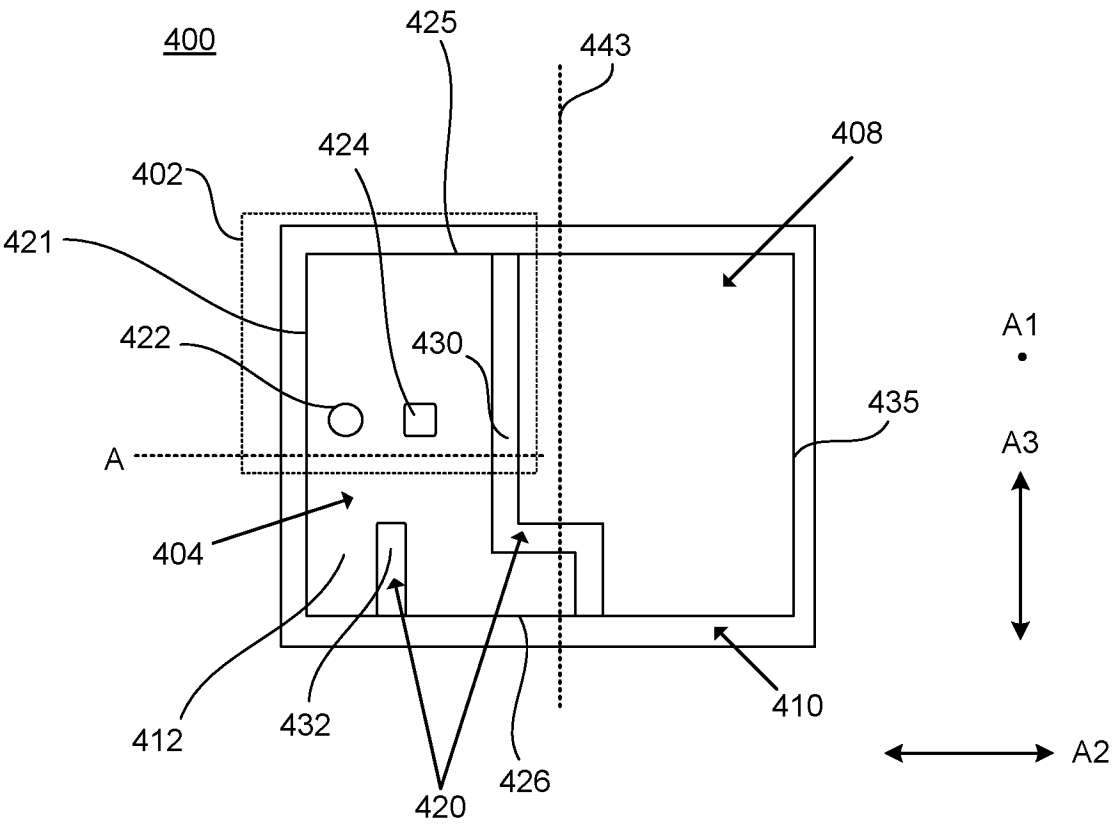
FIG. 4 illustrates a display device having an antenna according to another aspect.

FIG. 4 illustrates a top view of a display device 400 having an antenna 404 according to another aspect. For example, the display device 400 uses a portion 412 of a display module 408 as a radiating element, where the portion 412 may have an irregular shape for a multi-band antenna. The display device 400 may include any of the features discussed with reference to the display device 100 of FIGS. 1A and 1B, the display device 200 of FIG. 2, and/or the display device 300 of FIG. 3. In some examples, FIG. 1B is a cross-sectional view of a portion 402 of the display device 400 taken across line A and includes any of the details discussed herein. The antenna 404 includes an antenna feed 422 and a ground component 424 as previously discussed with reference to FIGS. 1A and 1B.

The display device 400 includes an air gap (e.g., the air gap 140 of FIG. 1B) between the display module 408 and an enclosure 410, and a ground wall 420 to electrically connect (e.g., ground) a portion of the display module 408 to the enclosure 410, thereby creating the antenna 404 using the portion 412 of the display module 408 as a radiating element. As shown in FIG. 4, the display module 408 may define an edge 421 and an edge 435. The distance between the edge 421 and the edge 435 in the direction A2 may define a width of the display module 408. The display module 408 may define an edge 425 and an edge 426. The distance between the edge 425 and the edge 426 in the direction A3 may define a length of the display module 408.

The ground wall 420 includes a ground wall portion 430 that extends in the direction A3 between a location aligned with the edge 425 and a location aligned with the edge 426. In some examples, the ground wall portion 430 extends across the length of the display module 108. In some examples, the ground wall portion 430 includes one or more portion that are parallel with a central axis 443 (e.g., the central axis 443 dividing the display module 408 into two equal parts) and one or more portions that are disposed at an angle (e.g., non-zero, perpendicular) with the central axis 443. In some examples, the ground wall 420 includes a ground wall portion 432 that extends from a location aligned with the edge 426 of the display module 408 in the direction A3. In some examples, the ground wall portion 432 is a component separate from and disposed a distance away from the ground wall portion 430. Although two ground wall portions are illustrated in FIG. 4, the display device 400 may include any number of ground wall portions such as a single irregular-shaped ground wall portion, or more than two ground wall portions. The ground wall portion 432 may create an additional antenna resonance (e.g., a multi-band antenna) by creating a separate current path. Also, the ground wall portion 432 may be used as a tuning element by altering the volume of the air gap created by the ground wall portion 430.

Figure 5:
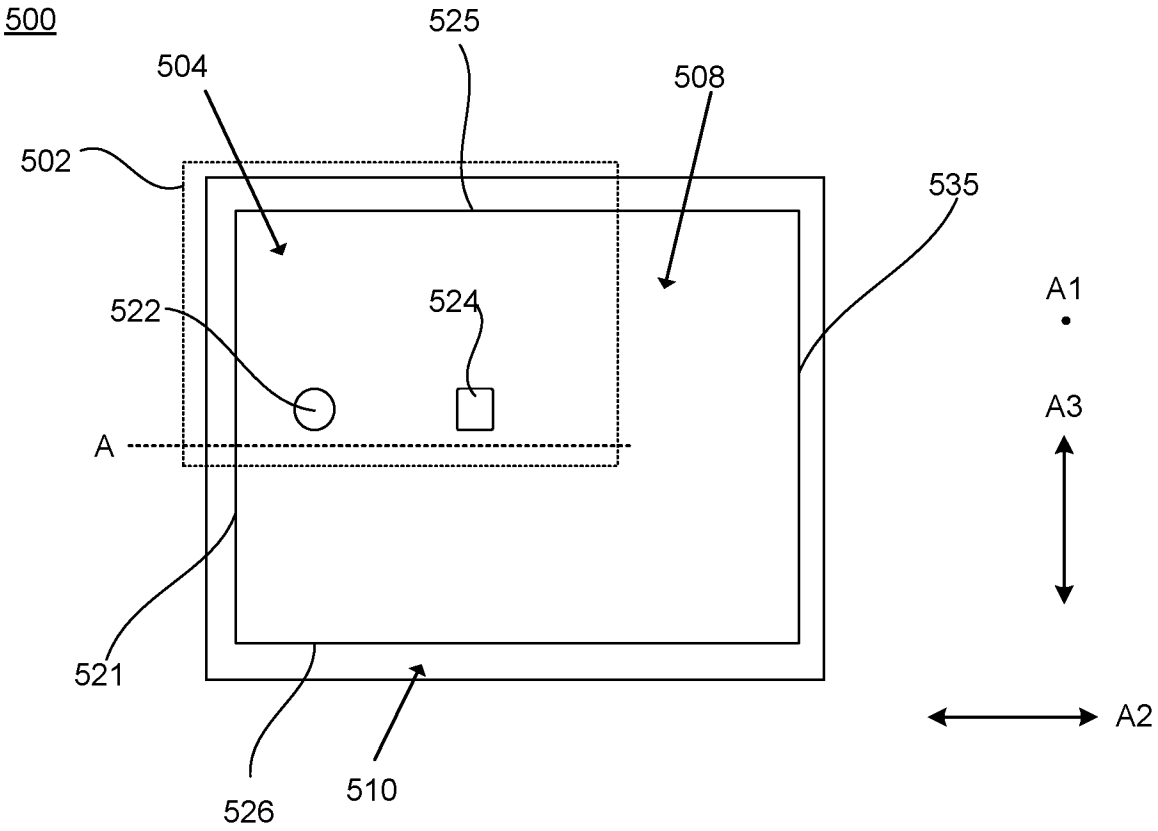
FIG. 5 illustrates a display device having an antenna according to another aspect.

FIG. 5 illustrates a top view of a display device 500 having an antenna 504 according to another aspect. For example, the display device 500 uses a display module 508 (as a whole) for the radiating element of the antenna 504. In some examples, the size of the display device 500 is relatively small, and the antenna 504 may be formed using the entire display module 508 as the radiating element. The display device 500 may include any of the features discussed with reference to the display device 100 of FIGS. 1A and 1B, the display device 200 of FIG. 2, the display device 300 of FIG. 3, and/or the display device 400 of FIG. 4 according to an aspect. In some examples, FIG. 1B is a cross-sectional view of a portion 502 of the display device 500 taken across line A. In some examples, the display device 500 does not include a ground wall (e.g., the ground wall 120 of FIGS. 1A and 1B). The antenna 504 includes an antenna feed 522 and a ground component 524 as previously discussed with reference to FIGS. 1A and 1B.

The display device 500 includes an air gap (e.g., the air gap 140 of FIG. 1B) between the display module 508 and an enclosure 510, thereby creating an antenna 504 using the display module 508 (as a whole) as the radiating element. As shown in FIG. 5, the display module 508 may define an edge 521 and an edge 535. The distance between the edge 521 and the edge 535 in the direction A2 may define a width of the display module 508. The display module 508 may define an edge 525 and an edge 526. The distance between the edge 525 and the edge 526 in the direction A3 may define a length of the display module 508. The antenna 504 may be an antenna with four edges defined by the display module 508, e.g., the edge 525, the edge 521, the edge 526, and the edge 535 such that the entire display module 508 is used as the radiating element.

Figure 6B:
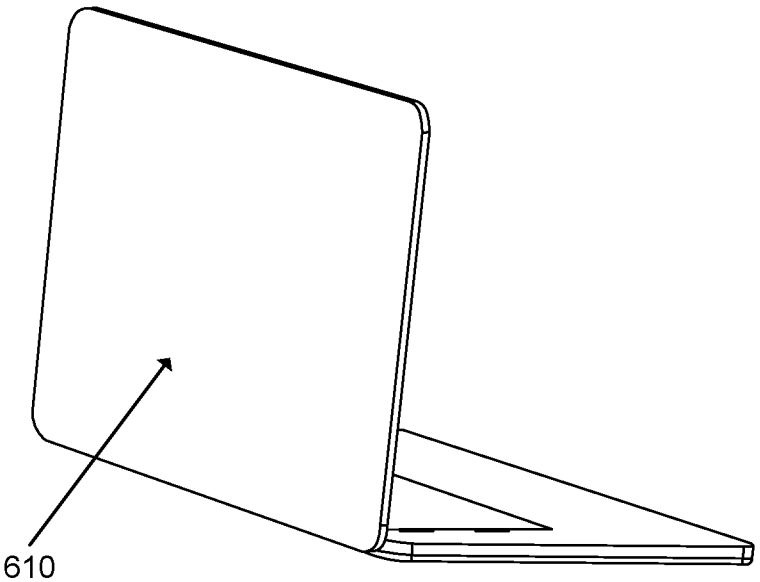
FIG. 6B illustrates a backside of the display device according to an aspect.
Figure 6A:
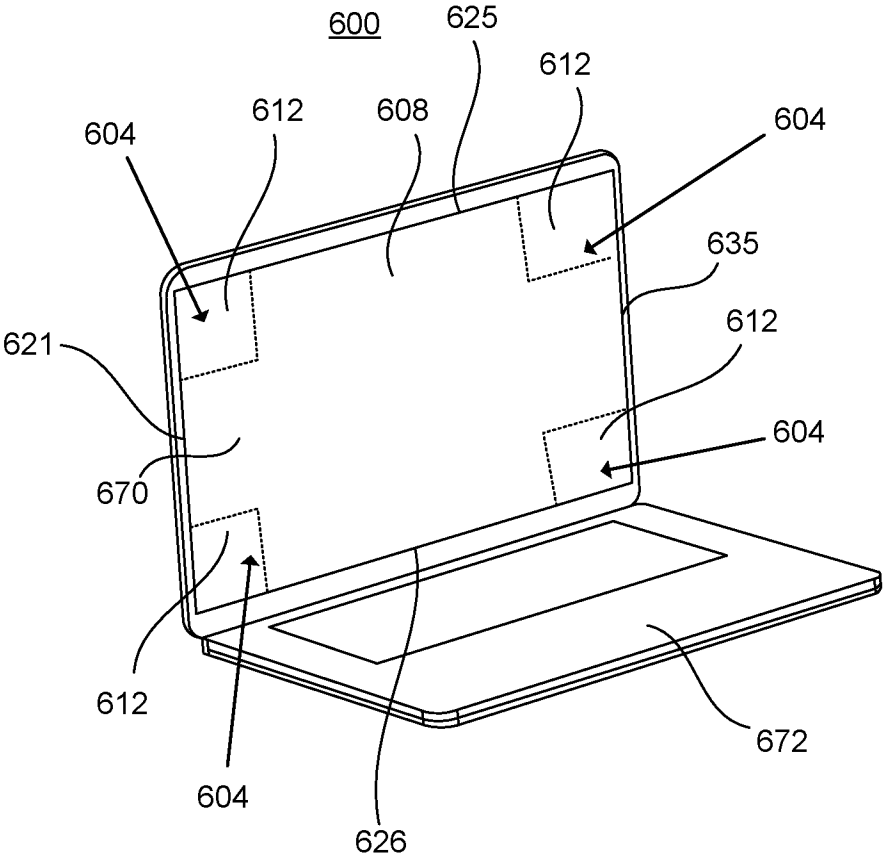
FIG. 6A illustrates a perspective of a display device that uses corner portions of a display module as radiating elements according to an aspect.
Figure 6C:
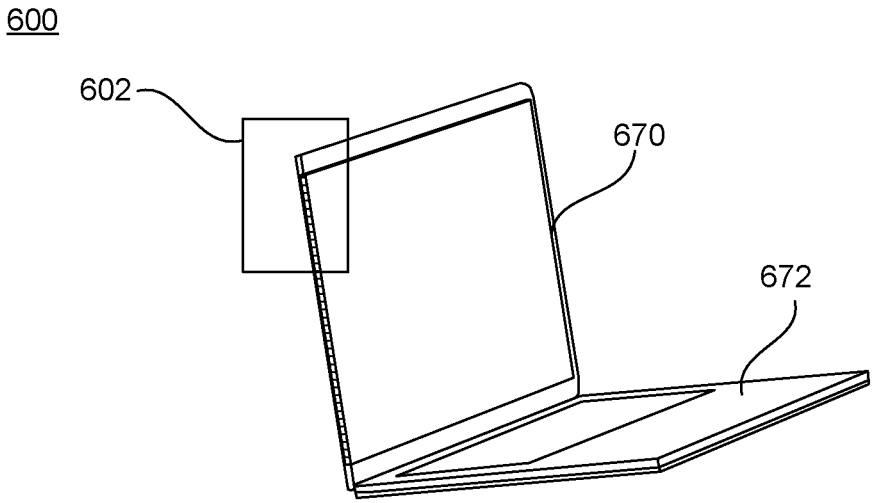
FIG. 6C illustrates a perspective of the display device according to an aspect.
Figure 6D:
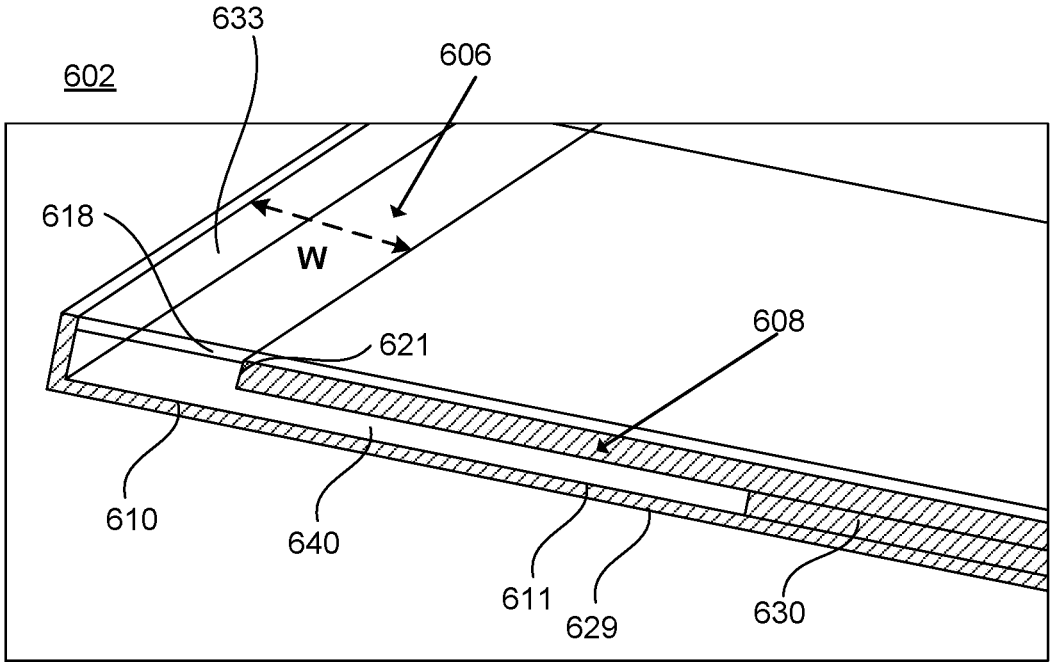
FIG. 6D illustrates a perspective of the display device creating an antenna space between a display module and an enclosure according to an aspect.
Figure 6E:
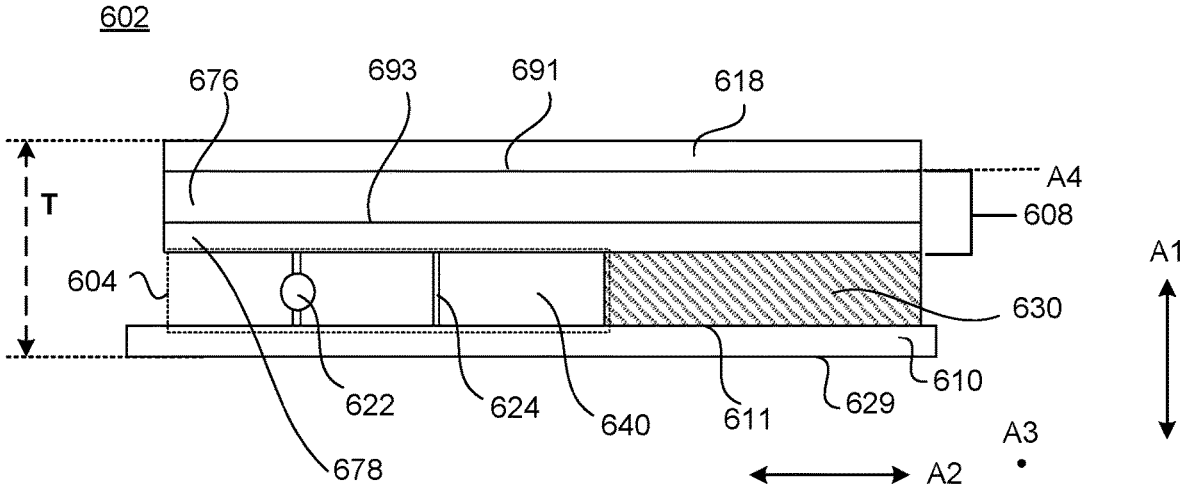
FIG. 6E illustrates a cross-sectional view of a portion of the display device depicting an antenna according to an aspect.
Figure 6F:
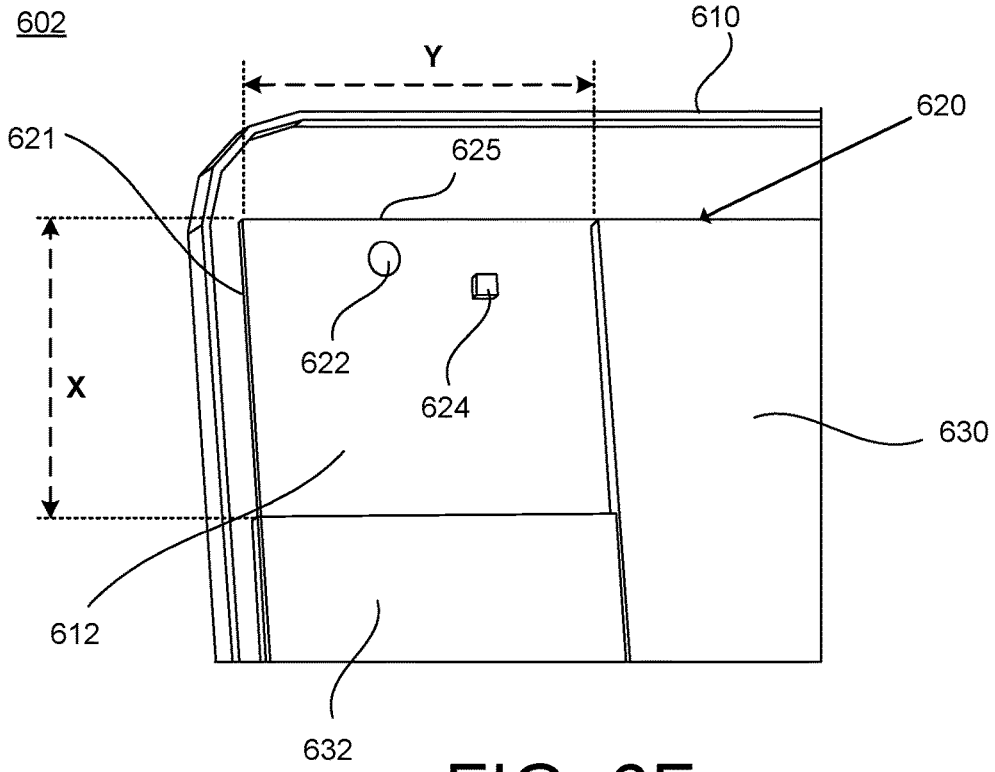
FIG. 6F illustrates a perspective of the portion of the display device depicting the antenna according to an aspect.

FIGS. 6A through 6F illustrate various perspectives of a display device 600 having multiple antennas 604 that use portions of a display module 608 as radiating elements according to an aspect. FIG. 6A illustrates a front-view perspective of the display device 600, and FIG. 6B illustrates a back-view perspective of the display device 600. FIG. 6C illustrates a perspective of the display device 600 that identifies a portion 602 (e.g., a corner portion) of the display device 600, and FIG. 6D illustrates the portion 602 of the display device 600 in greater detail. FIG. 6E illustrates a cross-section of the portion 602 of the display device 600 in greater detail, and FIG. 6F illustrates a front-view perspective of the portion 602 of the display device 600.

In some examples, similar to the display device 200 of FIG. 2, the display device 600 defines a separate antenna 604 using a separate portion 612 (e.g., a corner portion) of the display module 608. FIGS. 6C through 6F illustrate a single antenna 604 that uses a portion 612 (e.g., top right corner portion) of the display module 608 as the radiating element. It is noted that the other three antenna 604 may include the same/similar features. The display device 600 may include any of the features explained with reference to the display device 100 of FIGS. 1A and 1B, the display device 200 of FIG. 2, the display device 300 of FIG. 3, the display device 400 of FIG. 4, and/or the display device 500 of FIG. 5.

Although the display device 600 is depicted as a laptop, the features for creating an antenna 604 that uses a portion 612 of the display module 608 as a radiating element may be applied to any type of display device. The display device 600 includes a display part 670 rotatably coupled to a base part 672. The display part 670 includes an enclosure 610 that surrounds the display module 608. In some examples, the design of the antenna 604 permits the enclosure 610 to be metal (e.g., fully metal), thereby increasing the durability of the display device 600 while not affecting the antenna's performance. In some examples, the antenna 604 is not defined in a bezel area 606, which may cause the width W of the bezel area 606 to be reduced (or eliminated) and/or the thickness T of the display part 670 to be reduced. Furthermore, since the antenna 604 may be defined using existing components of the display device 600, the display device 600 may not include other typical antenna parts as slots (e.g., slots in the enclosure or frame), metal (antenna) traces, antenna wires, printed monopoles, patch antenna components, metal materials defining patterns or slots, mesh metal layer(s), ceramic antenna components, laser direct structure antenna components, and/or flex traces.

The display device 600 includes a transparent substrate 618 coupled to the display module 608. The transparent substrate 618 may be constructed from one or more transparent materials such that visual data can pass through the transparent substrate 618. In some examples, the transparent substrate 618 includes glass cover.

The display module 608 may define the display screen (e.g., the active viewing area) of the display device 600. In some examples, the display module 608 includes an array of diodes as pixels for a video display. The display module 608 may define an edge 621 and an edge 635. The distance between the edge 621 and the edge 635 may define a width of the display module 608. The display module 108 may define an edge 625 and an edge 626. The distance between the edge 625 and the edge 626 may define a length of the display module 108.

The display module 608 may include a display panel 676 and a conductive layer 678 coupled to the display panel 676. The display panel 676 includes a first surface 691 and a second surface 693. In some examples, the first surface 691 is a touch panel. In some examples, the first surface 691 is an indium tin oxide (ITO) layer of the touch panel. The first surface 691 of the display panel 676 is coupled to the transparent substrate 618. The first surface 691 of the display panel 676 is disposed in a plane A4. As previously discussed, the direction A1 is aligned perpendicular to the plane A4, and the direction A2 is perpendicular to the direction A1. The direction A3 is aligned parallel to the plane A4 and is orthogonal to directions A1 and A2.

The display panel 676 may be a liquid crystal display (LCD) panel, a light emitting diode (LED) panel, an organic light emitting diode (OLED) panel, or an active matrix organic light emitting diode (AMOLED) panel. In some examples, the display panel 676 includes one or more substrates such as a thin-film transistor (TFT) array, one or more polarizing plates, a backlight unit (BLU), one or more transparent layers, and/or one or more conductive films, etc. The conductive layer 678 may include one or more metal-based materials (e.g., aluminum, magnesium, alloy, titanium, copper, silver, gold, etc.). The conductive layer 678 may be coupled to the second surface 693 of the display panel 676. In some examples, the second surface 693 of the display panel 676 is the BLU.

The enclosure 610 (also referred to as a case or housing) may be constructed from one or more conductive materials such as metal-based material(s) (e.g., aluminum, magnesium, alloy, titanium, copper, silver, gold, etc.). In some examples, the enclosure 610 is entirely metal. In some examples, the enclosure 610 is a full metal cover surrounding the display module 608. In some examples, the enclosure 610 includes one or more metal portions and one or more non-metal portions. The enclosure 610 includes an interior surface 611 and an outer surface 629 disposed opposite to the interior surface 611. The outer surface 629 of the enclosure 610 may define the bottom exterior surface of the display device 600. In some examples, the enclosure 610 includes a sidewall 633. The sidewall 633 (or portions thereof) may be orthogonal to the interior surface 611 and the outer surface 629.

The display device 600 includes one or more ground walls 620 disposed between the display module 608 and the enclosure 610. The ground wall(s) 620 electrically connect (grounds) portions (e.g., bottom portions) of the display module 608 to the enclosure 610. The ground wall(s) 620 may be a conductive structure (or multiple separate conductive structures) having one or more conductive materials configured to ground portions of the display module 608 to the enclosure 610 and create air gaps 640 between portions of the display module 608 and the enclosure 610. In some examples, the ground wall(s) 620 include one or more conductive gaskets. In some examples, the ground wall(s) 620 includes one or more metal springs, conductive foam, and/or conductive fiber, etc.

With respect to a particular antenna 604, the ground wall 620 includes a ground wall portion 630 and a ground wall portion 632. In some examples, the ground wall portion 630 and the ground wall portion 632 form an L shape at a corner portion of the display part 670. The display module 608 includes a portion electrically grounded to the enclosure 610. For example, the ground wall portion 630 is disposed between the portion of the display module 608 and the enclosure 610.

The antenna 604 is formed at least by the air gap 640 between a portion of the display module 608 and the enclosure 610. For example, the air gap 640 between the enclosure 610 (e.g., a metal enclosure or an enclosure having a metal portion) and the conductive layer 678 of the display module 608 creates the structure of the antenna 604 when portions of the display module 608 is electrically connected (grounded) to the enclosure 610. The antenna 604 has a first edge defined by the edge 621 of the display module 608 and a second edge defined by the edge 625 of the display module 608.

The antenna 604 includes an antenna feed 622 coupled to the display module 608 and the enclosure 610. The antenna feed 622 is disposed within the air gap 640. The antenna feed 622 is coupled to the conductive layer 678 of the portion 612 of the display module 608. The antenna feed 622 is coupled to the interior surface 611 of the enclosure 610. In some examples, the interior surface 611 is metal or includes one or more conductive portions. In some examples, the antenna feed 622 is a transmission line (e.g., cable) that connects the antenna 604 with a transmitter and/or receiver (not shown).

The antenna 604 includes a ground component 624 coupled to the display module 608 and the enclosure 610. In some examples, the ground component 624 is a conductive structure (e.g., metal-based structure) that connects a portion of the display module 608 to the enclosure 610. In some examples, the ground component 624 is a ground leg. In some examples, the ground component 624 is a ground pin. The ground component 624 is disposed within the air gap 640. The ground component 624 is coupled to the conductive layer 678 of the portion 612 of the display module 608. The ground component 624 is coupled to the interior surface 611 of the enclosure 610. In some examples, the antenna feed 622 is positioned at a location that is closer to a location aligned with the edge 621 of the display module 608 than the ground component 624. In some examples, the air gap 640 only includes the antenna feed 622 and the ground component 624 (e.g., the air gap 640 is devoid of physical components except for the antenna feed 622 and the ground component 624).

As shown in FIG. 6F, the portion 612 of the display module 608 configured as the radiating element is a corner portion of the display module 608. In some examples, the portion 612 has a rectangular shape. The portion 612 of the display module 608 may have a width (Y) that extends from the edge 621 of the display module 608 to the ground wall portion 630 and a length (X) that extends from the edge 625 to the ground wall portion 632. In some examples, the width (Y) of the portion 612 of the display module 608 is in a range of 30 to 70 millimeters. In some examples, the width (Y) of the portion 612 of the display module 608 is in a range of 40 to 60 millimeters. In some examples, the length (X) of the portion 612 is in a range of 30 millimeters to 50 millimeters. In some examples, the length (X) of the portion 612 is in a range of 35 millimeters to 45 millimeters.

Thus, various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims. Also, the particular naming of the components, capitalization of terms, the attributes, data structures, or any other programming or structural aspect is not mandatory or significant, and the mechanisms that implement the invention or its features may have different names, formats, or protocols. Further, the system may be implemented via a combination of hardware and software, as described, or entirely in hardware elements. Also, the particular division of functionality between the various system components described herein is merely exemplary, and not mandatory; functions performed by a single system component may instead be performed by multiple components, and functions performed by multiple components may instead be performed by a single component.

Some portions of the above description present features in terms of algorithms and symbolic representations of operations on information. These algorithmic descriptions and representations may be used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "receiving", or "processing" or "computing" or "calculating" or "determining" or "displaying" or "providing", or "partitioning", or "constructing", or "selecting", or "comparing" or the like, refer to the action and processes of a computer system, or similar electronic computing device, that manipulates and transforms data represented as physical (electronic) quantities within the computer system memories or registers or other such information storage, transmission or display devices.

It will be appreciated that the above embodiments that have been described in particular detail are merely example or possible embodiments, and that there are many other combinations, additions, or alternatives that may be included.

What is claimed is:

1. A display device comprising:

a display module including a display panel and a conductive layer;

an enclosure configured to surround the display module, the enclosure including a conductive portion; and an antenna having a structure formed by an air gap located between the conductive layer and the conductive portion of the enclosure, wherein:

the antenna includes an antenna feed located within the air gap, the antenna feed being coupled to the conductive portion of the enclosure and to the conductive layer such that a portion of the display module is configured as a radiating element for wireless communication, and the portion of the display module configured as the radiating element is defined by a ground wall of the display module that is electrically connected with the enclosure;

a transparent substrate coupled to the display panel, the enclosure including an interior surface and a sidewall, the interior surface including the conductive portion; and a bezel area disposed between an edge of the display module and the sidewall.

2. The display device of claim 1, wherein the portion of the display module configured as the radiating element is a corner portion of the display module.

3. The display device of claim 1, wherein the portion of the display module configured as the radiating element is a side portion extending from a first edge of the display module to a second edge of the display module.

4. The display device of claim 1, wherein the antenna includes a ground component disposed within the air gap, the ground component being coupled to the conductive layer and to the enclosure.

5. The display device of claim 1, wherein the air gap has a thickness in a range of 1-2 millimeters.

6. The display device of claim 1, wherein the antenna is one of a plurality of antennas included within the display device, each of the plurality of antennas configured to cause a respective corner portion of the display module to operate as a separate radiating element for the wireless communication.

7. The display device of claim 1, wherein a width of the bezel area is less than one millimeter.

8. The display device of claim 1, wherein the ground wall is disposed adjacent to the air gap.

9. The display device of claim 1, wherein the ground wall includes a conductive gasket.

10. The display device of claim 1, wherein the ground wall includes a first ground wall portion and a second ground wall portion, the first ground wall portion extending from a location aligned with a first edge of the display module, the second ground wall portion extending from a location aligned with a second edge of the display module.

11. A display device comprising:

a display module including a display panel and a conductive layer;

an enclosure configured to surround the display module, the enclosure including a conductive portion; and an antenna having a structure formed by an air gap located between the conductive layer and the conductive portion of the enclosure, wherein:

the antenna includes an antenna feed located within the air gap, the antenna feed being coupled to the conductive portion of the enclosure and to the conductive layer such that a portion of the display module is configured as a radiating element for wireless communication, the antenna is one of a plurality of antennas included within the display device, each of the plurality of antennas configured to cause a respective corner portion of the display module to operate as a separate radiating element for the wireless communication;

the respective corner portion of the display module configured as the radiating element is defined by a respective ground wall of the display module that is electrically connected with the enclosure;

each of the plurality of antennas has a structure formed by a separate air gap disposed between the conductive layer of the display module and the enclosure, and each antenna includes a separate antenna feed disposed within the respective separate air gap and coupled to the conductive layer and to the enclosure.

12. A display device comprising:

a display module including a display panel and a conductive layer;

an enclosure configured to surround the display module, the enclosure including a conductive portion; and a conductive body disposed between the conductive layer of the display module and the conductive portion of the enclosure; and an antenna having a structure formed by an air gap located between the conductive layer and the conductive portion of the enclosure, wherein:

the antenna including an antenna feed located within the air gap, the antenna feed being coupled to the conductive portion of the enclosure and to the conductive layer such that at least a portion of the display module is configured as a radiating element for wireless communication, and the portion of the display module configured as the radiating element is defined by a ground wall of the display module that is electrically connected with the enclosure;

a transparent substrate coupled to the display panel, the enclosure including an interior surface and a sidewall, the interior surface including the conductive portion; and a bezel area disposed between an edge of the display module and the sidewall.

13. The display device of claim 12, wherein the conductive body includes at least one of a metal spring, a conductive foam, or a conductive fiber.

14. The display device of claim 12, wherein the air gap has an end defined by the conductive body.

15. The display device of claim 12, wherein a width of the bezel area is less than one millimeter.

16. The display device of claim 12, wherein the antenna is one of a plurality of antennas included within the display device, each of the plurality of antennas configured to cause a separate portion of the display module to operate as a separate radiating element for wireless communication.

* * * * *